US008230621B2

(12) United States Patent
Shmurak et al.

(10) Patent No.: US 8,230,621 B2
(45) Date of Patent: Jul. 31, 2012

(54) SHOE WITH REMOVABLE AND RECONFIGURABLE UPPERS

(75) Inventors: Yelena Shmurak, Newtown, PA (US); Leon Shmurak, Newtown, PA (US)

(73) Assignee: Stylsh, LLC, Newtown, PA (US)

( * ) Notice: Subject to any disclaimer, the term of this patent is extended or adjusted under 35 U.S.C. 154(b) by 462 days.

(21) Appl. No.: 12/554,177

(22) Filed: Sep. 4, 2009

(65) Prior Publication Data

US 2011/0056091 A1 Mar. 10, 2011

(51) Int. Cl.
*A43B 7/26* (2006.01)
*A43B 3/24* (2006.01)
*A43B 3/12* (2006.01)

(52) U.S. Cl. ..... 36/100; 36/11.5; 36/101; 36/15

(58) Field of Classification Search ..... 36/11.5, 36/15, 100, 101, 94
See application file for complete search history.

(56) References Cited

U.S. PATENT DOCUMENTS

| | | | | | |
|---|---|---|---|---|---|
| 2,112,761 | A * | 3/1938 | Buehner | 36/11.5 |
| 3,199,232 | A | 8/1965 | Pike | |
| 3,290,802 | A | 12/1966 | Fukuoka | |
| 3,336,683 | A | 8/1967 | Schellkopf | |
| 3,698,107 | A * | 10/1972 | Fukuoka | 36/11.5 |
| 3,710,592 | A | 1/1973 | Scow | |
| 4,051,610 | A * | 10/1977 | Shigeji | 36/11.5 |
| 4,172,330 | A * | 10/1979 | Kao | 36/11.5 |
| 4,584,782 | A * | 4/1986 | Thatcher | 36/11.5 |
| 4,864,736 | A * | 9/1989 | Bierk | 36/11.5 |
| 5,533,278 | A * | 7/1996 | Stein | 36/11.5 |
| 5,852,885 | A | 12/1998 | Ferniani | |
| 6,769,204 | B1 | 8/2004 | Phillips | |
| 6,848,199 | B1 | 2/2005 | Giannelli | |
| 7,117,615 | B2 * | 10/2006 | Gerber | 36/101 |
| 7,222,441 | B2 | 5/2007 | Smith et al. | |
| 7,347,010 | B2 | 3/2008 | Yu | |
| 7,481,008 | B2 | 1/2009 | Lusk | |
| 7,540,098 | B2 | 6/2009 | Bast et al. | |
| 7,650,704 | B2 * | 1/2010 | Richardson | 36/11.5 |
| 2004/0064976 | A1 | 4/2004 | Barteet | |
| 2004/0093765 | A1 | 5/2004 | Baldwin | |
| 2006/0201027 | A1 | 9/2006 | Wu | |
| 2006/0288610 | A1 * | 12/2006 | Laska et al. | 36/11.5 |
| 2008/0052958 | A1 | 3/2008 | Pan | |
| 2009/0038181 | A1 * | 2/2009 | Loughnane | 36/94 |
| 2009/0249650 | A1 * | 10/2009 | Sarantakos | 36/101 |
| 2009/0260260 | A1 * | 10/2009 | Whitaker et al. | 36/101 |
| 2010/0132223 | A1 * | 6/2010 | Lewis | 36/101 |

FOREIGN PATENT DOCUMENTS

JP 04361701 A * 12/1992

* cited by examiner

*Primary Examiner* — Marie Patterson
(74) *Attorney, Agent, or Firm* — Duane Morris LLP

(57) ABSTRACT

An shoe assembly includes a sole and one or more detachable upper pieces that can be made from materials such as fabric, PVC, leather, plastic, rubber, other similar materials and combinations. The upper, in one or more pieces, is removably attached at spaced points on the sole, where nail-shaped posts are permanently mounted. The heads of the posts function as buttons or cleats for buttonholes, keyholes, edge loops or the like on the uppers. Interchangeable uppers can have different materials, shapes and decorative aspects, for quickly and efficiently changing the appearance and style of the footwear. Three posts can be provided, with a front post being inclined rearward and having a slot under the head or cleat, where the upper is attached, and lateral posts with heads turned outwardly. A variety of alternative configurations are possible for the uppers.

16 Claims, 8 Drawing Sheets

Figure 1:
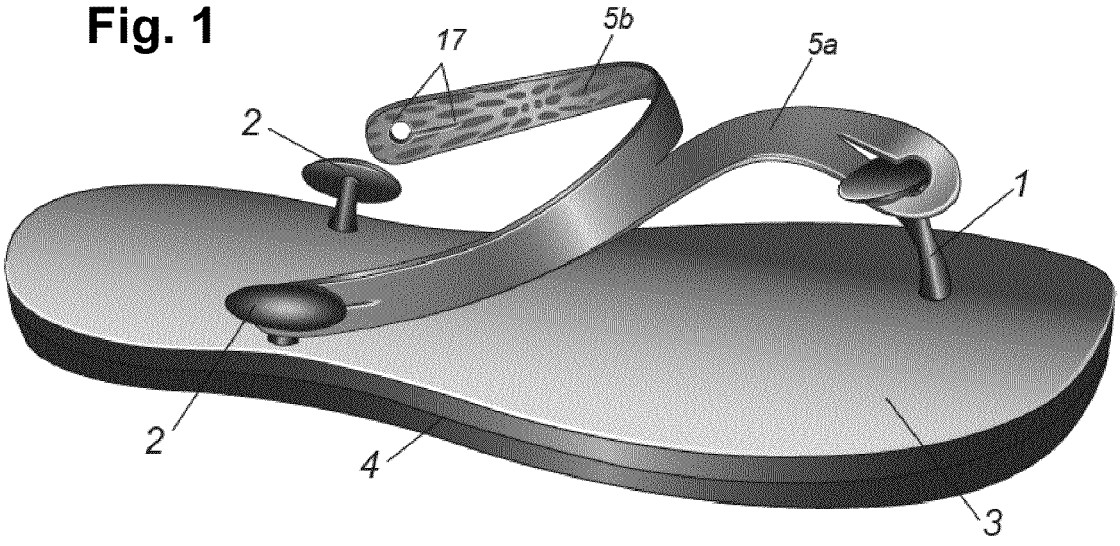

Fig. 4a
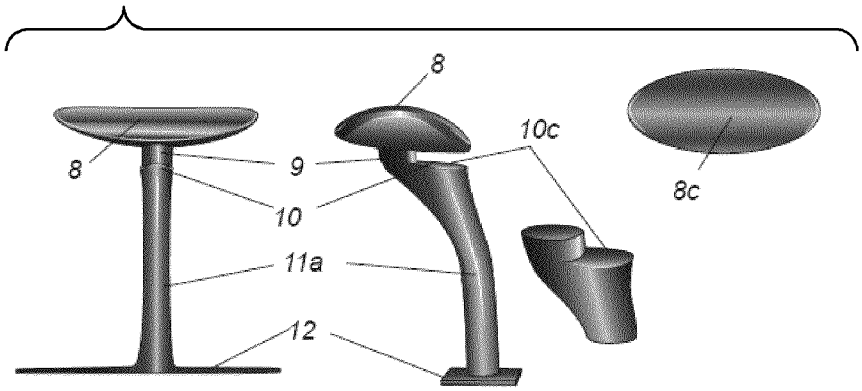
Fig. 4b
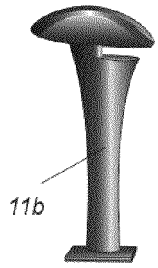
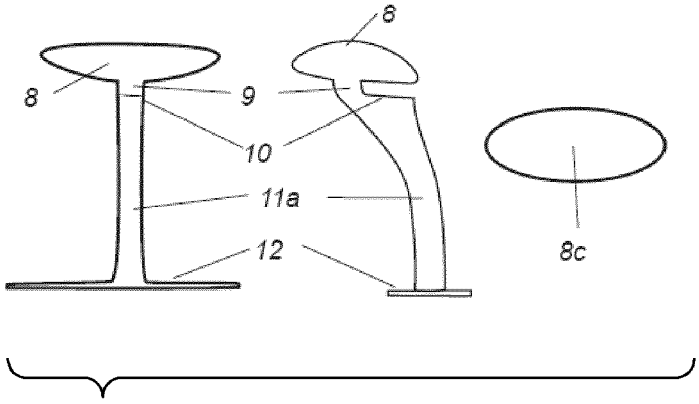
Fig. 4c
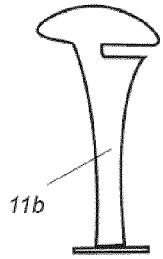
Fig. 4d

Fig. 6a
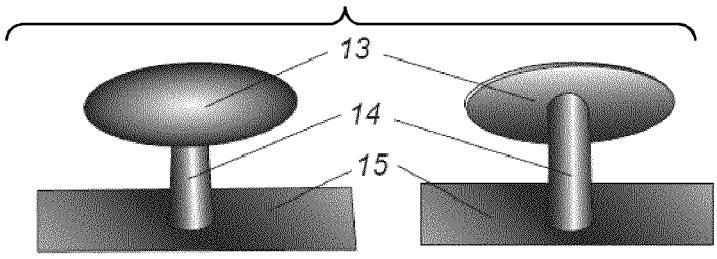
Fig. 6b
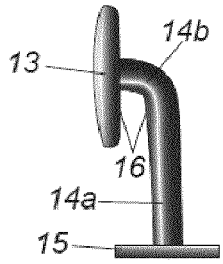
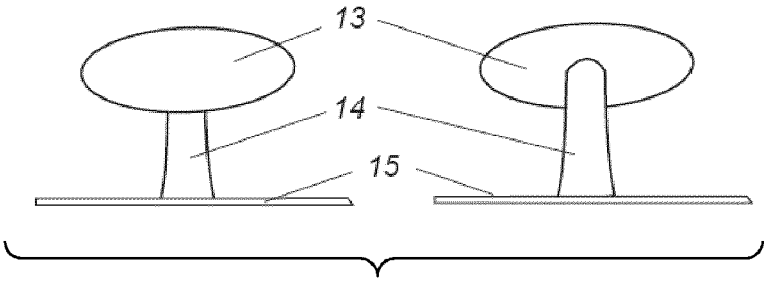
Fig. 6c
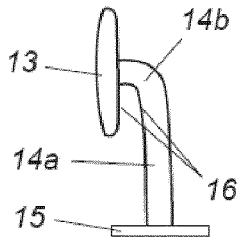
Fig. 6d

Fig. 7a
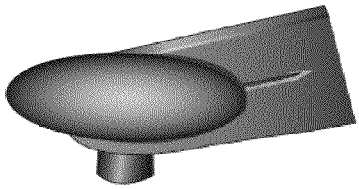
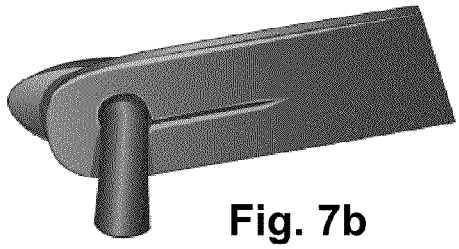
Fig. 7b
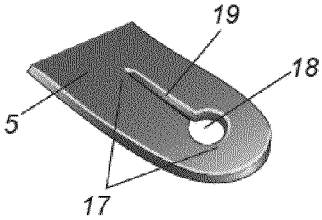
Fig. 7c
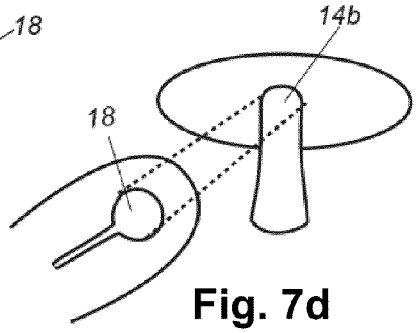
Fig. 7d
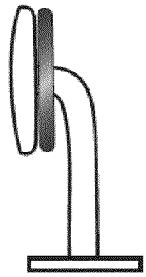
Fig. 7e
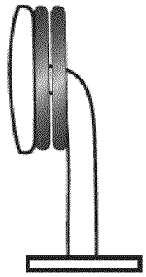
Fig. 7f

SHOE WITH REMOVABLE AND RECONFIGURABLE UPPERS

BACKGROUND

1. Field of the Disclosure

This disclosure relates to footwear with interchangeable parts. Sandals such as thong-type flip-flop sandals are provided with anchoring posts at the front and near the side edges of a sole or platform, the posts having shafts with enlarged ends resembling nail heads. Different straps and strap configurations can be attached at the posts to produce alternative configurations for the sandal uppers, including variable ankle and instep strap arrangements and alternatives for shape, color and surface configuration.

2. Related Art

A simple form of sandal has a sole part that slightly exceeds the surface area occupied by the foot, and one or more strap or upper parts that are affixed to the sole part at spaced locations. The wearer's foot occupies a space between the upper (such as a strap) and the top surface of the sole. In different arrangements of shoes, the upper may define an open or closed toe and might or might not have sidewalls and a heel. However in sandals, the foot is generally exposed. Straps extend over the instep between spaced points to hold the shoe on the wearer's foot.

The sole can be a simple panel of constant thickness, possibly with laminated layers. In sandals known as flip-flops, a typical sole is a 2 cm thick lamination of rubber or plastic sheets. The sole alternatively can comprise a more rigid or durable material such as wood or leather. The sole can vary in thickness or shape, e.g., having a relatively thicker and/or higher heel part.

The upper of the shoe typically at least has a strap that extends laterally from attachment points at or near opposite edges of the sole. This strap can be wide or narrow. In flip-flop or thong sandals, there is also an attachment point at the front of the sole, spaced several cm back from the front edge, where one or more straps is affixed to the sole at a point located between the wearer's great toe and second toe. In this arrangement, there are typically two straps, each extending from the front attachment point to a point at or near a respective lateral edge of the sole, perhaps 8 or 10 cm rearward from the front edge of the sole. The two straps are typically provided in an integrally molded V-shaped strap element having three connecting points. At each connecting point, a shaft or post penetrates through at least an inner (upper) lamina of the sole and terminates in a flat disc-shaped plug having a larger diameter than the shaft or post. During assembly, the terminating plugs are forced through holes in the inner/upper sole layer. The plugs reside in counterbores that are cut or molded into the underside of the sole (in the underside of the inner/upper layer or in a lower laminated layer). The counterbores have a depth equal to the thickness of their respective discs, and anchor the ends of the straps. The plugs may be exposed on the underside of the sole, or the underside of the sole may have an additional laminated layer that covers the plugs.

In a basic form, the upper or thong portion consists of two straps joined together and attached to the sole at the point between the toes. The other ends of the straps are attached at the lateral edges of the sole, some distance back from the front attachment. The points of attachment in some configurations are forward of the wearer's ankle and in others are at the ankle or aft of the ankle. Some variations can be found, for example, in U.S. Pat. No. 3,290,802—Fukuoka, which has a cross-member connecting at midpoints of the straps; U.S. Pat. No. 3,336,683—Schellkopf or U.S. Pat. No. 4,051,610—Shigeji, which have ankle straps that can reside behind the ankle; and U.S. Pat. No. 7,540,098—Bask et al., wherein the straps can have plural sections and are affixed at their ends in alternative ways; etc.

Shoes and sandals are known wherein the upper part of a shoe or a part such as a strap forming an enclosure for the foot, is arranged to be detached so that the upper can be replaced with one of a different width or shape or color or surface configuration. U.S. Pat. No. 6,769,204—Phillips and U.S. Pat. No. 7,481,008—Lusk disclose thong sandals wherein the thongs are not removable but are adapted to receive interchangeable decorative covers, affixed adhesively atop the straps, and changed when the wearer chooses to adopt a different theme or color scheme.

Although attachment arrangements are generally known for shoe uppers, what still is needed is an effective way to provide detachable interchangeable uppers for thong-type flip-flop sandals. It is not practical to expect users to exchange the uppers of sandals by pulling out the anchoring plugs and mounting different uppers by forcing the plugs of the different uppers into position. Changing cover tapes on thong straps is superficial. What is needed is an effective way to anchor the uppers of thong sandals or similar footwear, that facilitates substantial changes, including changes in the configuration of the uppers, preferably not only as to surface decoration but also to vary the structural nature of the footwear, to increase or decrease the extent of coverage of the foot, and to open new opportunities for footwear styling.

SUMMARY

According to the present disclosure, a configuration is established whereby the uppers of thong sandals and similar footwear are removably attachable at least at three points of connection to a sole member. A forward point of connection is made at the location that is typical of thong sandals such as "flip-flops," namely in the interdigital space between the great toe and second toe. Two rearward points of connection are made through at least the surface of the sole, spaced back from the front connection to approximately the location of the ankle. The connections do not involve removable anchoring posts. Instead, each of the three connections has a permanently affixed anchoring post protruding from the sole and forming a standard defining a cleat at which the ends of one or more straps can be coupled. More particularly, the forward post provides a cleat or enlargement at an elevation immediately over the toes. The rearward posts protrude upwardly from the sole and are bent laterally outwardly, as well to provide a cleat on either side of the foot.

The cleats can be generally button-shaped and form attachment points for shoe uppers. In respective embodiments, exemplary uppers can comprise single linear straps, straps configurations with wye ("Y") or vee ("V") forms affixed to the posts at their ends, triangular, oval or otherwise-shaped panels affixed at their corners or edges, ankle enclosing shoe-like and boot-like uppers, and other similar arrangements. An object therefore is to provide and optimally to configure shoes with uppers that are removable, interchangeable, remountable or adjustable to assume one of two or more alternative positions, and in some embodiments to make the uppers reversible on the sole, or reversible together with swapping the uppers between the left and right shoe.

The cleats of the posts can comprise domed button ends with a circular or oval shape, molded integrally with a post and an anchoring disc. Other similar shapes are possible, characterized by an enlargement of diameter at the end of the post, or at least at a space from the surface of the sole. The cleat at the front post preferably forms a radial slot in the post, under the button or dome, which slot captures an end of each strap or a button hole or loop coupled to an upper having a sheet form. The slot establishes a height for the connection of the strap to the post that is spaced to an elevation above the sole, the height above the sole being approximately equal to the thickness of the wearer's foot. According to certain embodiments discussed below, the front post can be inclined somewhat toward the rear. The front post can be relatively soft and flexible, and/or elastically extendable under tension, for the wearer's comfort and with the further benefit of allowing a given size of upper to accommodate some variation in the size of the wearer's foot.

The upper may comprise, without limitation, strap ends with holes or a sheet with slots forming buttonholes, or loop ends, etc. The upper is attachable to the sole at lateral sides of the foot, via attachments for removably affixing the upper. The attachments at the lateral sides comprise at least two posts that are each spaced rearward from the front post and are respectively located on opposite sides near the lateral edges of the sole. These posts preferably are bent outwardly to terminate in cleats or buttons. Thus a vertical part of each post leads from the sole into a short laterally inclined or even horizontal part adjacent to an enlargement of diameter at the end of the attachment post. Whereas a flat strap or sheet material upper stretches across the surface of the foot, this bent-over arrangement of the lateral attachment posts orients the cleat or button to engage with the plane of the sheet-material or strap upper that is wrapped over the wearer's foot. The cleat or button is widened in a direction parallel to the sheet or strap material and the post is substantially perpendicular to the sheet or strap material. The ends of two or more straps or other upper structures can be overlapped and affixed at the same post by placing the upper structures over one another on the post.

Various sheet materials are apt for use as straps or sheet material uppers. Among others, the uppers may comprise leather, natural or synthetic fur pelt, fabric that is woven, knitted or formed in a batt, plastic polymer sheets, basket materials such as wood canes and other fibers from vegetation, collapsed tubing of plastic or rubber, and so on. The uppers need not be limited to sheets of uniform thickness, and arbitrary shapes can be used as uppers, for example with elastic loops attached at locations enabling arbitrary shapes to be attached to the sole via the posts and cleats.

According to one aspect, the sandal construction as disclosed is capable of exchangeable uppers, not limited to straps and not limited to exchanges of different colors or surface configurations. Uppers of different shapes can be employed. The uppers have holes or slots or loops or similar fixtures complementary to the domed buttons or other post enlargements serving as cleats. In this context, it should be appreciated that the different uppers that are possible are such that the conventional notion of a sandal as a shoe wherein the foot is affixed to a sole by one or more straps, is no longer adequate. The upper can comprise one or more integral parts and can wholly or partly enclose or wrap over or wrap around the leg at the ankle, the ankle and/or all or part of the foot.

In one embodiment, the uppers comprise a V-shaped double strap typical of a thong sandal, with a connection with the sole made between the point of the V-shape and the front post and the connections with the ends of the legs of the V-shape and the sole made at the lateral posts. It is also possible to employ a V-shape wherein the end of one leg attaches at the front, while the lateral posts receive the other leg and the point of the V-shape. Other possibilities include configurations with more than three such posts and configurations wherein the posts are asymmetrically arranged.

In another embodiment, a strap extending between the lateral posts and cleats can extend over the foot in front of the ankle or to the rear of the ankle. Still other embodiments form a panel extending in an approximately triangular shape between the posts. Alternatively, the panel can have an oval or other shape. Embodiments with shoe-like uppers can attach at the posts and also extend around the ankle. The upper can be tubular configuration, for example enclosing around parts of the foot and/or ankle like portions of a sock or boot. Alternatively, the upper can have edges that are affixed to one another across an opening to enclose the ankle, for example with closures such as straps or laces or other fasteners such as hooks and eyes, snaps, buttons, Velcro material or the like joining edges of the upper in front of the ankle or behind the ankle. In another alternative, an inserted or included portion of the upper can be elastic, and/or a closure for the coupling across an opening in the upper can comprise an elastic, for easy insertion and removal of the foot into and from the shoe. Various materials and configurations and combinations are made possible, wherein the upper is attached to the sole via the front and lateral posts as described.

Unlike known configurations, the straps or other upper structures that are affixed at the connection points do not require any specific angular orientation relative to the post to which the structures connect. As a result, a strap that extends over and across the sole between the rearward lateral connection points (instead of forward to the toe post) can be arranged to reside in front of the wearer's ankle or behind the ankle. This aspect can be exploited by locating the rearward posts at points that are substantially aligned with or centered between the forward and rearward surfaces of the foot at the ankle, such that a strap of a given length can fit in front or behind the ankle. Alternatively, the posts can be off center, requiring a longer or shorter strap in configurations wherein the strap is used on one side of the ankle or the other.

Straps or panel or tubular uppers can be provided with alternative connection points. An elastic strap or a length-adjustable strap can be provided and made longer or shorter for comfort or such that the same upper member (e.g., a strap) can be deployed along a longer or shorter transit between connection points. The strap connections can enable the same strap or upper configuration to be attached with either side up. Providing straps with different colors or surface configurations on opposite sides and the capability to affix the straps with either side up, enables configurations with distinct appearances using the same straps. Generally, when reversing sheet-material uppers, it is also necessary to exchange the reversed uppers for the left and right shoe.

These and other aspects and objects will be apparent in view of the following discussion of several embodiments that are intended as non-limiting examples, showing some of the advantages that the disclosed structures provide.

BRIEF DESCRIPTION

The drawings demonstrate exemplary embodiments of the subject matter of the disclosure, but the invention is not limited to the embodiments disclosed as examples. Reference should be made to the appended claims rather than the examples in order to assess the scope of the invention in which exclusive rights are claimed. In the drawings, FIG. 1 is a perspective view showing an exemplary embodiment of a sandal with removable and reconfigurable straps, only right foot sandal being shown from a left/right symmetrical pair.

FIGS. 2*a* through 2*d* are perspective views showing a sandal with an exemplary embodiment of a strap configuration, for example of polyvinyl chloride (PVC), and showing several steps in assembly and reconfiguration.

FIGS. 3*a* through 3*d* illustrate several alternative embodiments for uppers in a generally sheet form, for example of fabric or other sheet material.

FIGS. 4*a* through 4*d* are several views showing an specific structure for a front connecting post in a generally nail-shaped post arrangement.

FIGS. 5*a* through 5*e* show the engagement of a front post as in FIGS. 4*a*-4*d* with a tab end of a strap or sheet coupling having a buttonhole shape with a hole having a diameter somewhat smaller than the nail head or cleat, extended by an adjoining slot providing clearance to pass the strap over the nail head.

FIGS. 6*a* through 6*d* are opposite side and end elevation views detailing the lateral connecting posts, in this embodiment with a 90° bend.

FIGS. 7*a* through 7*f* are several partial views showing the attachment of a strap to a lateral connecting post as in FIGS. 6*a*-6*d*, including a view (FIG. 7*f*) wherein two straps are stacked on a connecting post.

FIGS. 8*a* through 8*d* are illustrations of alternative arrangements for coupling sheets and loops to connecting posts as discussed.

DETAILED DESCRIPTION

Referring to FIG. 1, a basic sandal structure comprising a sole or platform and a shoe upper structure is configured according to the present disclosure with a removable, replaceable and/or reconfigurable upper. The upper is attached to the platform sole panel by fasteners comprising connection posts or standoffs generally resembling nails with nail heads. More particularly, a plurality of nail-shaped fasteners 1, 2 comprise shaped cleats to which portions of the upper are removably attached.

In this embodiment, there are three nail-shaped fasteners. It would be possible to provide more than three. The nail-shaped fasteners can be separately molded elements, of a material that is flexible but relatively stiffer than the sole, for example of polyvinyl chloride (PVC). The posts of the fasteners can be permanently affixed in the sole by plug anchors. One of the fasteners 1 resides between the toes and can be made of a relatively softer material compare to the two lateral posts 2. Instead of forming the nail-shaped fasteners as separate elements with plug anchors, the fasteners can be molded in one integral piece, for example of ethylene vinyl acetate, injection molded onto a sole member. In that case, the anchoring part is a laminated layer of the sole, joined integrally with the posts 1, 2.

In the example shown in FIG. 1, the upper comprises a strap in a wye configuration that includes a strap end part 5*a* for engaging the forward or toe post 1 and two strap ends 5*b* that each attach to one of the lateral posts 2. In this embodiment, the sole member or platform comprises a cushioned surface layer 3 adhered with a base or ground-engaging layer 4, adhered to layer 3 so as to form the sole. The posts 1, 2 are permanently attached to the sole, for example because the lower ends of posts 1, 2 have base parts (which can be separate or integral as described) captured between layers 3, 4. Alternatively, the posts 1, 2 define plug-like enlargements that reside in shallow counterbore holes on the underside of the sole in a manner similar to the way that integrally molded plastic upper straps are affixed in the form of sandals commonly known as "flip-flops."

The sole or platform part of the shoe can be more or less complicated. A simple sole comprises a solid flat slab of material. The slab may have a shape in plan view resembling the outline of a footprint. In other embodiments, the slab can be a laminate of plural layers. A softer side can face the wearer and a tougher side can face the ground. The laminate layers can include a layer that is integrally molded with the posts 1, 2. The sole or platform can be contoured, for example having a raised arch for orthopedic support and comfort and/or sloping surfaces that complement the wearer's foot and help to maintain a fixed position of the foot relative to the sole when walking, particularly as further supported by the show upper configurations disclosed herein. Exemplary sandals are disclosed in U.S. Pat. No. 4,051,610—Shigeji, and published application 2006/0201027—Wu, and in the documents cited above under "related art," the disclosures of which are hereby incorporated by reference in their entireties.

Although a right foot sandal is shown, this is of course one of a pair of shoes. The dimensions of the soles and the dimensions of the uppers preferably are available in a range of sizes for different sizes of foot. Different sizes of uppers can be provided as well, either in grades corresponding to the grades of the soles or in more grades or fewer grades to accommodate different lengths, widths and instep heights of wearers' feet.

Figure 2A:
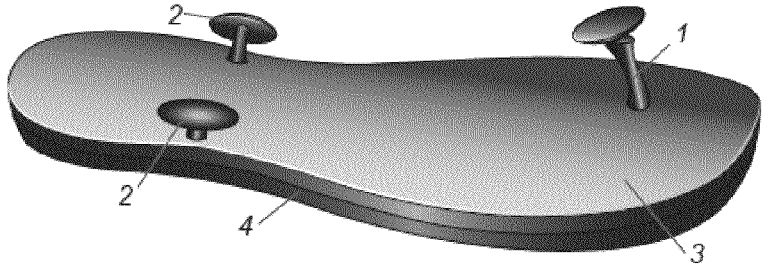
Figure 2B:
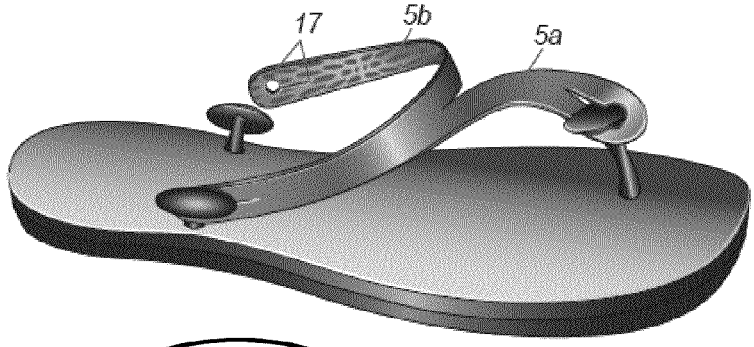

The uppers are removable by detachment from the connecting posts 1, 2, and replaceable by attaching other uppers of different form, shape, material or other character, several examples of which are disclosed herein as examples. In FIG. 2*a*, the upper has been detached, namely by disengaging the ends from the nailhead shaped cleats of connecting posts 1, 2. In FIG. 2*b*, a keyhole-shaped opening is provided in the upper at the point to be attached to a connecting post 2. A round or otherwise shaped through hole is adjoined to a slot in the strap of the upper, which comprises a flexible material. It is possible by to fit the nailhead cleat of the post through the opening defined by the hole and slot together, as shown at the front post 1 in FIG. 2*b*. The tension on the strap thereafter holds the post in the through hole and holds the slot closed, removably retaining the strap in place.

Figure 2C:
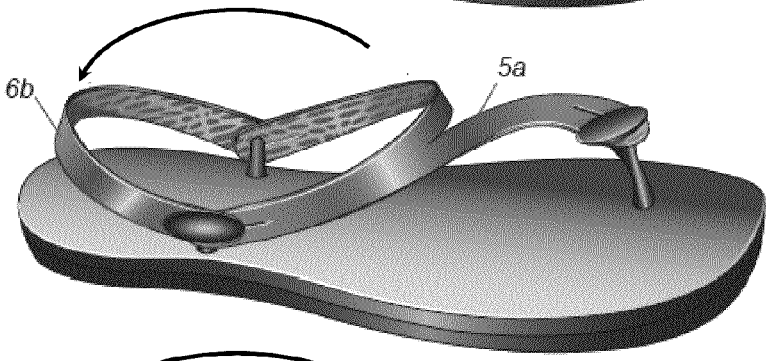
Figure 2D:
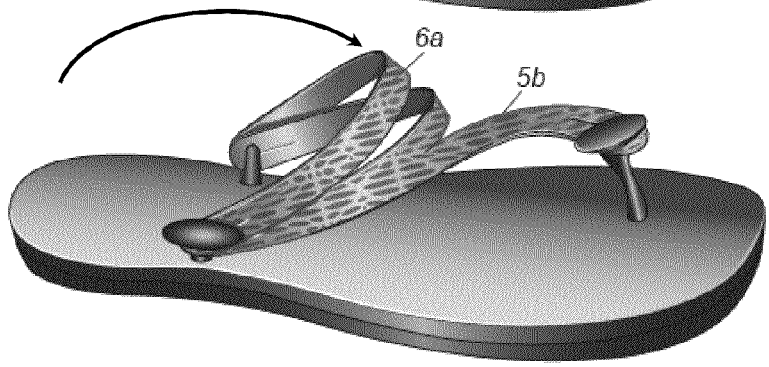

FIG. 2*c* illustrates that the upper on the sandal may comprise more than one integral part and comparing FIGS. 2*c* and 2*d*, portions of the upper may be displaceable relative to other portions. In FIG. 2*c*, a single length strap 6*b* is attached between the lateral connecting posts 2 and is positioned to function as a rear ankle strap for additional support and attachment of the sandal to the foot. FIG. 2*d* shows that the same single length strap can be used as an instep strap 6*a*, e.g., by rotating the strap to the front before donning the sandal. FIG. 2*c* also shows that either or both of the upper parts can be turned over to show the underside (both having been turned over, and at least part 5*a*/5*b* having been switched from a left foot to the right foot, to show their undersides). The opposite sides of the uppers can have different appearances with respect to color, ornamentation, surface configuration, affixed indicia, etc.

Preferably, at least three nailhead connecting posts or fasteners 1, 2 are provided so that the upper pieces can be attached to the shoe platform in a secure yet easy and comfortable way. The front post forms a standoff by which the nailhead or cleat enlargement is located over the toes. In connection with the lateral posts 2, the posts form a laterally outwardly oriented angle. The section of the post adjacent to the nailhead cleat can be oriented substantially at a right angle, forming an axis on which the ankle strap can rotate. The front connecting post likewise provides a flexing connection between the upper and the post 1. The posts can comprises a relatively hard rubber or plastic composition but nevertheless allow the sandal to flex comfortably when walking. The front post 1 located between the toes optionally can be made of a relatively softer material than lateral posts two. The front post, or all the posts, optionally can be partly covered with a cushioning material (not shown) in the areas that are contacted by the toes or the sides of the foot.

In the configuration shown in FIG. 2*d*, the sandal is generally of a "flip-flop" configuration in that there is no rear obstruction, and the wearer readily can step out of the shoe to the rear. In FIG. 2*c*, the rotation of the strap to rear strap position at 6*b* effectively converts that footwear into a foot engaging sandal by including the rear strap for support. However, the sandal and/or show configurations with straps are one of a wide variety of possible configurations wherein all or part of the upper can be in the form of a sheet or a strap or band, or in some combination of such shapes. Several alternative upper shapes are shown in FIGS. 3*a* through 3*d*, wherein a portion of the upper comprises a fabric or similar sheet structure.

Figure 3A:
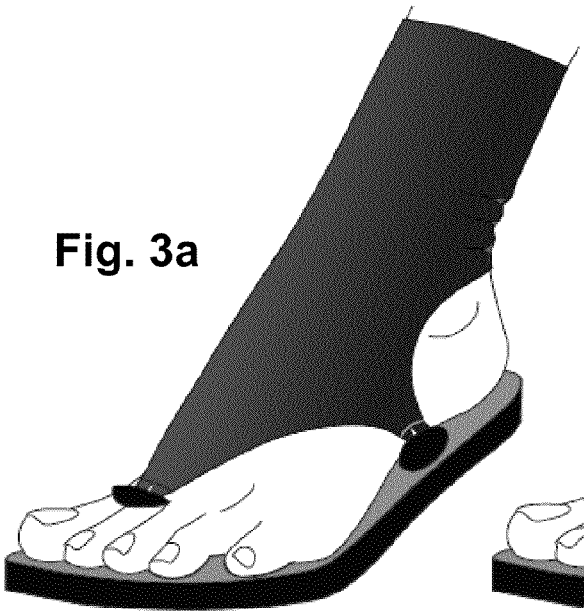

Referring to FIG. 3*a*, the shoe platform has attached a fabric upper that forms a partial boot shape. More particularly, a triangular part disposed between the connection posts 1, 2 is joined integrally with an extension proceeding rearward and upward to engage at least partly around the leg at the ankle. This provides additional support and certain opportunities for stylistic and aesthetic variations, such as fold over cuffs or flaps (not shown). The extension can be tubular such that the foot is pushed and pulled through the tubular extension when putting the shoe on or taking the shoe off. This can be done while the upper remains attached to the platform or not, as desired. Alternatively the extension can be provided with a closure (not shown) along the side or back. Suitable closures might include hooks and eyes, buttons, Velcro, a zipper or another such closure mechanism.

Figure 3B:
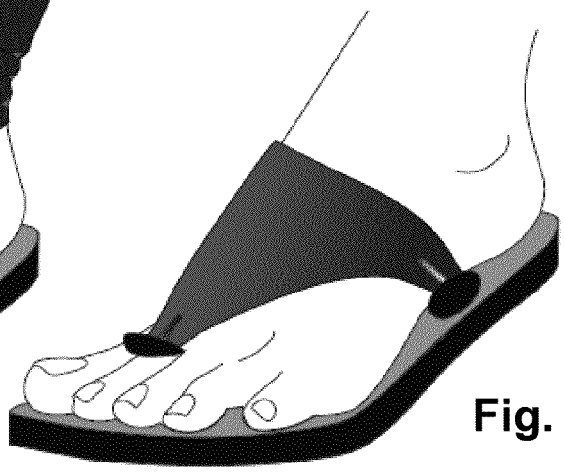
Figure 3C:
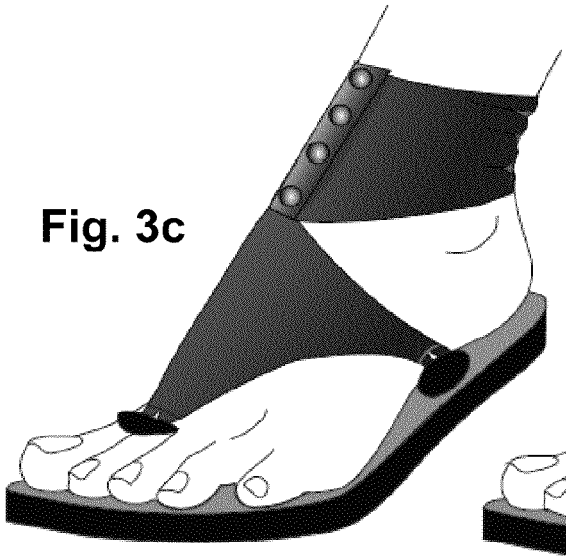

In FIG. 3*b*, the upper is limited to a flexible sheet in a triangle without the leg enclosure. In FIG. 3*c*, a triangle is continued into an ankle strap with a closure at the front, generally illustrated to represent, for example, buttons, a zipper, snaps or the like. Providing a closure is useful for easier shoe entry and also raises opportunities to include aesthetic details. Various different materials and combinations of materials can be used for the uppers, such as fabrics, leather, rubber, plastic, plant material and other flexible or semi-flexible materials.

Figure 3D:
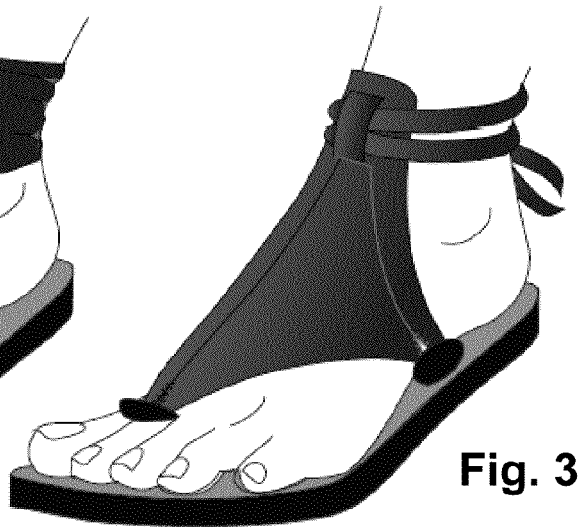

FIG. 3*d* shows that the upper and/or the closure for the upper can vary in additional ways. In this embodiment, the generally triangular flexible sheet between the connecting posts 1, 2 is continued in a tongue portion that extends up the front side of the foot at the ankle, to a loop for receiving laces or ribbons straps to be tied at the rear. These arrangements, like those discussed above, are all interchangeably enabled by the nailhead shaped cleats and connection posts to which any of the uppers is easily attached and detached.

FIGS. 4*a* through 4*d* show certain details of a preferred embodiment of the front connection post and nailhead cleat. In general a front dome-shaped nailhead forms a cleat 8 on which the upper engages. The preferred cleat 8 has lateral undersides that slope or curve upwardly away from the post, to enhance comfort and reduce chafing between and atop the adjacent toes (not shown). The front nailhead cleat can be graded. Generally it is sufficient to have coarse grading, e.g., Small, Medium and Large, although the grading can be such that different sizes are provided for each different size of sole platform size.

In the embodiments shown in FIGS. 4*a*-4*d*, the post 11*a* is provided with a particularly advantageous structure for its function as the front nailhead cleat mounting in a removable upper sandal. The post 11*a* is inclined somewhat to the rear from its connection at the base. A slot is formed under the nailhead cleat 8 back to the neck 9 at which the cleat 8 is joined with the post 11*a*. This provides a step 10 and a pinch zone between the cleat 8 and a top surface 10*c* of the post 11*a* below the cleat 8. When walking, the underside of the cleat 8 repeatedly bears down toward surface 10*c*, providing a secure attachment with the upper. Inasmuch as the material of the upper is captured in the slot, the elevation of the upper from the sole is maintained, and the upper does not tend to slide down the post to the sole, when the wearer's foot is removed from the shoe.

The connecting post shaft 11*a* is inclined and/or bent backward along its length, which limits the fore-and-aft flexing of the shaft 11*a* when walking because tension is more nearly aligned to the elongation of shaft 11*a*. The oval button shape 8*c* has a major axis oriented laterally of the foot and perpendicular to the slot in a buttonhole opening in the upper, or perpendicular to the direction of tension in an elastic loop connection to the upper. These arrangements provide a secure and comfortable connection for flexible sheet and/or strap uppers comprising fabric, leather or other similarly flexible materials. In one example, the angle of rearward inclination is between 155 and 175 degrees, with an optimum angle of about 165 degrees, as measured between the longitudinal axis of the post 1 and the horizontal surface of the sole to the rear of the post.

The front and lateral connecting posts 1, 2 preferably are permanently captured in the sole, but there are alternatives ways that this can be done. In one embodiment, a nail base 12 is integrally molded with the connecting post and comprises a disk or square or other shape of material extending radially outwardly from the post at the bottom. The nail base 12 can be slightly wider that the diameter of the post or much wider, preferably having a width that approximates the width of the cleat or button 8, at least in a lateral direction and optionally all around the base. When the sole is constructed, the upper lamination(s) of the sole can have holes for the posts 1, 2, while the lower lamination(s) do not. The posts are pressed through the holes during assembly. The base 12 of each post is adhered between the laminations of the sole, permanently affixing the connecting posts 1, 2 in the sole. In an alternative embodiment (not shown), the posts can have bases of a complementary shaped openings in one or more lower or internal laminations, whereas the holes in the upper laminations closely match the outside diameter of the posts 1, 2. The preferred shapes for the bases in multilayer sole assemblies is rectangular. The preferred shape for single layer outsoles is a rounded or oval shape. In a further alternative, the posts 1, 2 can be molded in an integral unit comprising the posts and also a laminated layer of the sole that serves as the anchor for all the posts.

Figure 5A:
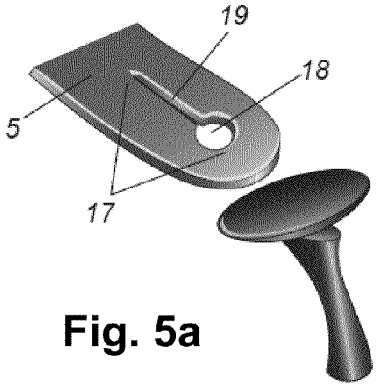
Figure 5B:
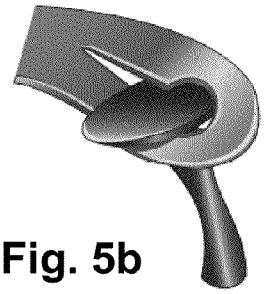
Figure 5C:
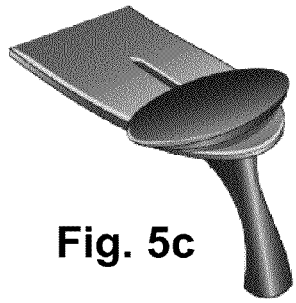
Figure 5D:
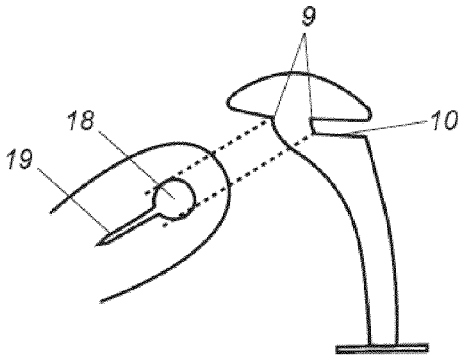
Figure 5E:
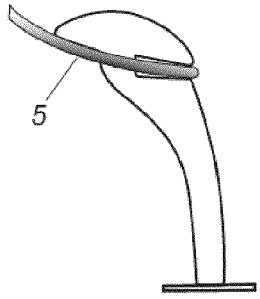
Figure 8A:
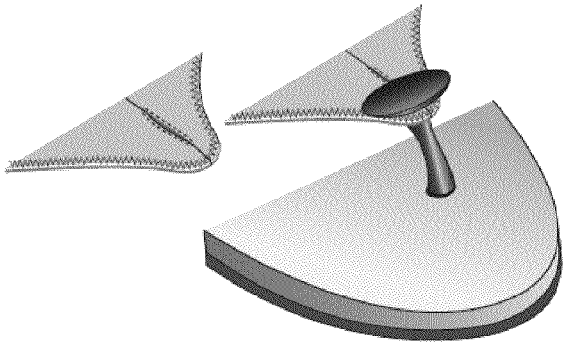
Figure 8B:
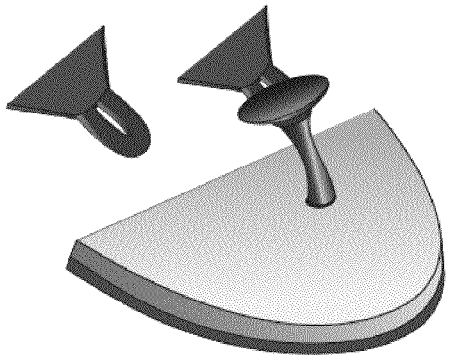
Figure 8C:
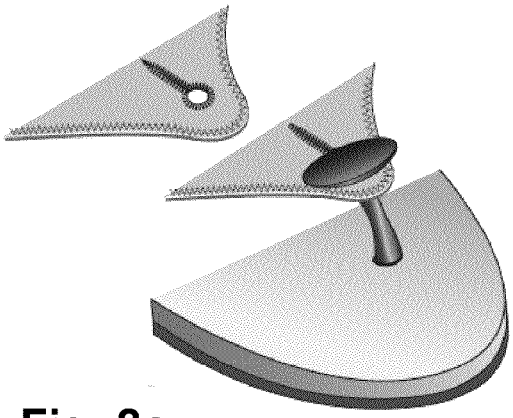
Figure 8D:
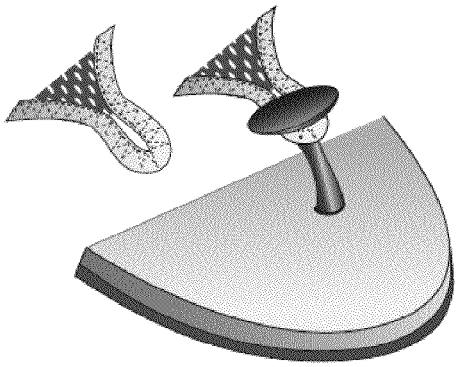

FIGS. 5*a*-5*c* illustrate steps in the attachment of a keyhole slotted tab with a front nail as described above in perspective view. FIGS. 5*d* and 5*e* respectively show side elevations corresponding to FIGS. 5*a* and 5C. In this illustration, the end 5 of the upper panel or strap is combination thereof is assumed to comprise a semi-flexible material such as PVC, rubber, plastic, leather or similar material. In FIG. 5*a*, the end 5 is detached from the nailhead cleat and front post. A keyhole shaped opening 17 in end 5 has a round through hole 18, with a diameter about 1 mm wider than the diameter of the neck part 9 of the post 11*a* at the radial slot 9, shown in FIGS. 4*a*-4*c*. Coupled to the through hole 18 is a long narrow cut out slit 19 in line with the longitudinal extension of end 5 (along the direction of tension). The slit is narrow, e.g., preferably about 1 mm, to achieve substantially full coverage of the wearer's foot with the end 5.

In FIG. 5B, the cleat is partly passed through the opening, including flexing the buttonhole to admit cleat 8. Finally, in FIG. 5*c*, the cleat is free of the opening and the upper end 5 is engaged on the cleat. These views are likewise represented in FIGS. 5*d* and 5*e*, where the through hole 18 is seen to fit snugly on neck 9. The extreme end of strap end 5 beyond through hole 18 can have a thickness that complements the space available in the slot 10 under the cleat button end 8 or the slot 10 can be wide enough to receive two or more thicknesses of upper material, or to accommodate thicker material than shown in the illustrations. Compare the width of slot 10 in FIGS. 5*d* and 5*e*. The key shaped button hole provides for control of relative movement. Upper piece 5 is free to rotate around neck 9 and to flex. Tension is applied along the end 5 when walking. But the engagement as shown minimizes relative movement between end 5 and neck 9 in a forward/backward direction. This key shaped button hole is preferred for use with an upper piece 5 made from semi-flexible material.

In FIGS. 6*a*-6*d*, the lateral connecting posts 2 are shown, and likewise comprise a button shaped cleat 13, a post 14 and a base 15. In FIGS. 6*a* (in perspective) and 6*c* (elevation), the lateral or rearward connection post 2 is shown in a view from the wearer's side, i.e., looking toward the side of the sandal. In FIGS. 6*b* and 6*d*, the connecting post 2 is shown from the front or rear. As described, the post 2 has a laterally outward bend along the standing part 14, namely between the proximal part 14*a* and distal part 14*b*, leading up to cleat 13. The base 15 can be structured similarly to the base structure used for the front posts as already discussed.

The cleat 13 has a flattened oval shape. For comfort, the nailhead cleat 13 has a rounded face and rounded edges. The rear side of the cleat 13 is straight and flat. A flat rear side achieve maximum surface contact with the upper piece 5, not shown in FIGS. 6*a*-6*d*. Similarly to the structure of the front cleat, the shaft part 14*b* of the lateral/rearward nailhead cleat receives an end 5 with a slotted or keyhole shape. The shaft part 14*b* has a diameter that is substantially the same as the diameter of the neck 9 of the radial slot of the front nail. (See neck 9 in FIG. 4*a*.) This permits use of uppers wherein the front and rearward button holes are the same size, and in some embodiments supports the attachment of the upper parts in alternative locations on the sandal.

The lateral/rearward connecting posts 2 have a bend forming an outward incline. The posts 2 are not radially slotted as is the front post 1. However there is a space 16 along the section 14*b* (see FIGS. 6*b*, 6*d*) defined between the nailhead cleat 13 and the vertical section 14*a*. The length of space 16 along section 14*b* is sufficient to admit the thickness of the upper part 5 but preferably only just sufficient. This space 16 maintains the position of the upper part 5 in a manner similar to the functioning of the radial slot 10 of the front nailhead cleat (see slot 10 in FIG. 4*a*). FIGS. 7*a*-7*f* show this function.

In FIGS. 7*a* and 7*b*, shown from opposite sides, an attachment for the end part 5 of an upper is to be made with a side nailhead cleat as described. The end part 5 can be a semi-flexible material as already described, with an opening 17 defined by a through hole 18 coupled to a slot 19 forming a keyhole in the flexible material, through which the cleat can be passed. Once inserted, tension on part 5 holds the hole 18 snugly on shaft section 14*b* at space 16 along the connecting post 2. The key shaped button hole permits free movement in a direction corresponding to rotation of part 5 around shaft section 14*b* while restricting or preventing forward/backward movements that would correspond to tightening and loosening of the upper on the foot. This arrangement allows easy shifting of a second strap between the instep strap and ankle strap positions 6*a*, 6*b*, shown in FIGS. 2*c*, 2*d*, and generally retains the upper part 5 in an orientation that is flat against the curved surfaces of the wearer's foot. Furthermore, as shown in FIG. 7*f*, the length of space 16 measured along section 14*b* can be made just sufficient to admit two thicknesses of the upper material 5 (or more or fewer thicknesses in an upper that is designed with that number of thicknesses, etc.).

FIG. 8 illustrates options for different structures for upper pieces that can attach to the nailhead cleats 1, 2 as described, the illustration showing uppers that are generally sheet shaped as in FIGS. 3*a*-3*d* but have alternative shapes and structures at the connection with a front nailhead cleat. In FIG. 8*a*, a longitudinal inseam is gapped and over-edge stitched to form a simple slot-shaped buttonhole. This form of buttonhole is useful for medium weight stretch fabrics, woven fabrics, leather, vinyl and similar materials, especially those that are subject to fraying. FIG. 8*b* illustrates a buttonhole in an upper comprising edge piping continued into a loop (sometimes termed a "spaghetti" loop), and may be made by forming a reinforced edge rolled and/or hemmed along the edge of the same fabric that forms the body of the upper 5. This form of buttonhole is useful for medium to light stretch fabrics, leather, and vinyl. In FIG. 8*c*, a key shaped embroidery type buttonhole is formed. It is useful as an attachment for woven, medium to heavy weight stretch fabrics, leather, and vinyl. FIG. 8*d* shows an elastic boundary loop affixed around the perimeter of the whole upper piece an continuing into a loop proceeding outwardly from the body of the upper. This attachment is useful for light stretch fabrics like mesh, knit, and lace.

As disclosed herein, the sandal or shoe has a sole 3, 4 shaped to support a human foot (not illustrated), a forward connection point 1 located at a point on the sole corresponding to a space between a great toe and a second toe of the foot, and at least two rearward connection points 2, located on the sole 3, 4 adjacent to lateral edges of the sole and spaced rearward from the forward connection point 1. The forward connection point 1 and rearward connection points 2 each comprise a post 11*a* or 14, affixed to the sole 3, 4, defining a shaft extending from a base 12 or 15 coupled to the sole, and a cleat 8 or 13 that can be formed by an integral enlargement along the post. At least one shoe upper part (FIGS. 1, 2*a*-2*d*, 3*a*-3*d*, etc) has openings 17, 18, 19, spaced and configured removably to engage the cleats 8 or 13.

In certain embodiments, an upper part 6*a*, 6*b* engages between only two of the cleats. Preferably the upper part (5*a*, 5*b* and FIGS. 3*a*-3*d*) engages between the forward connection point and at least one of the two rearward connection points, and more preferably to rearward connection points on both laterally opposite sides of the shoe in a strap configuration or as a panel or as an enclosure for part or all of the foot. In addition to panel embodiments, e.g., as in FIG. 3*b* and/or strap configurations as in FIGS. 1, 2*b*-2*d*, structural and style related variations are employed including arrangements that enclose wholly or partly around a wearer's ankle, in a tubular part, optionally with a closure.

In exemplary strap configurations, at least three strap ends having openings are configured to engage the cleats of the forward connection point and one of the rearward connection points. The openings can be defined by at least one of a hole, a slot and a loop at least at one end of strap. The strap ends can be parts of an integral upper member or a sewn or adhesively attached assembly with distinct straps that are integrally separate or unitary or affixed to one another, with connection points adjacent to ends respectively connectable to two of the cleats. In one embodiment, a strap connected between the rearward connection points is displaceable to a position in front of an a position behind an ankle of the wearer, by pivoting ends of said strap relative to respective ones of the cleats.

In a preferred arrangement, the post of the forward connection point is inclined toward the rear and also forms a receptacle slot 10 along the post 11*a* for affixing the upper part at a space from a base 12 affixed to the sole. The receptacle can be defined at least partly by a reduced diameter at a neck 9 along the shaft 11*a* adjacent to the cleat 8. The shoe upper part is held in this receptacle slot 10. At the rearward connection points, the corresponding shaft 14 is bent outwardly at a point spaced above the sole, for example at substantially a right angle, and preferably such that the distance along the leg 14*b* between the cleat 13 and the bend forms a space 16 that is complementary with the expected thickness of the shoe upper part, such as two thicknesses in the case where two straps are superimposed under the rearward connection point cleat 13.

The disclosed structures and alternative configurations provide a number of advantages. An interchangeable shoe ensemble is possible by attaching selected uppers or by changing the configuration of attachment in a shoe/sandal having easily interchangeable/replaceable upper components. A wide variety of different appearances and aesthetics are provided, which may be chosen and changed as needed for different occasions or for different times of the day, not only for selection of an appropriate appearance but also, for example, for cool comfort in the day, perhaps with light PVC straps, and switching to stitched cotton in the evening for warmth. The embodiments with relatively larger uppers resembling boot uppers have the further advantage of securely affixing the wearer's foot and ankle relative to the sole platform and may have orthopedic advantages. The sandals are designed for comfort with minimum effort and are of modest cost. Re-using the basic shoe soles for with different uppers is space saving and efficient of resources. The ability to attach widely different upper structures serves the wearer's creativity.

The subject invention has been disclosed in connection with a number of alternatives, examples and preferred embodiments. Nevertheless, the invention is not limited to the embodiments disclosed as examples. Reference should be made to the appended claims rather than the foregoing specification to assess the scope of the invention in which exclusive rights are claimed.

What is claimed is:

1. A shoe comprising:

a sole shaped to support a human foot;

a forward connection point located at a point on the sole corresponding to a space between a great toe and a second toe of the foot;

at least two rearward connection points located on the sole adjacent to lateral edges of the sole and spaced rearward from the forward connection point;

wherein the forward and rearward connection points each comprise a post affixed to the sole, defining a shaft extending from the sole, and a plurality of spaced cleats are formed by an enlargement along posts of the respective said connection points;

further comprising at least one upper part forming a panel of sheet material having openings spaced and configured removably to engage each of the cleats of the forward and rearward connection points, the panel covering an upper side of the foot at least over an area between the forward and rearward connection points; and wherein the panel of the upper part comprises a portion substantially encircling a leg of a wearer of the shoe at the ankle.

2. The shoe of claim 1, comprising a plurality of alternative upper parts, each of the upper parts being interchangeably removable and attachable to the shoe by disengaging said one upper part from the cleats and engaging one of the alternative upper parts with the cleats.

3. The shoe of claim 2, wherein the one shoe upper part and the alternative shoe upper parts are different from one another in at least one of material, shape, surface configuration, structure, and decorative design.

4. The shoe of claim 1, wherein the upper part forms an at least partly tubular enclosure for a part of the ankle.

5. The shoe of claim 1, further comprising a closure for the upper part, the closure completing an at least partly tubular enclosure of the upper part around the ankle.

6. The shoe of claim 5, wherein the closure comprises at least one of a button, a hook and eye, a strap, a lace, and a hook and pile closure.

7. The shoe of claim 1, wherein the upper comprises strap ends on the panel, having openings spaced to engage the cleats of the forward connection point and one of the rearward connection points.

8. The shoe of claim 7, wherein the openings are formed by at least one of a hole, a slot and a loop at least at one end of strap.

9. The shoe of claim 1, wherein the post of the forward connection point forms a receptacle along the post for affixing the upper part at a space from the sole.

10. The shoe of claim 1, wherein the post of at least one of the rearward connection points is bent outwardly at a point spaced above the sole.

11. A shoe comprising:

a sole shaped to support a human foot;

a forward connection point located at a point on the sole corresponding to a space between a great toe and a second toe of the foot;

at least two rearward connection points located on the sole adjacent to lateral edges of the sole and spaced rearward from the forward connection point;

wherein the forward and rearward connection points each comprise a post affixed to the sole, defining a shaft extending from the sole, and a plurality of spaced cleats are formed by an enlargement along posts of the respective said connection points;

further comprising at least one upper part having openings spaced and configured removably to engage the cleats;

wherein the post of the forward connection point forms a receptacle along the post for affixing the upper part at a space from the sole; and, wherein the receptacle is defined at least partly by a reduced diameter along the shaft adjacent to the cleat, the upper part being held at the receptacle.

12. The shoe of claim 11, wherein the shoe upper part comprises at least two distinct straps with connection points adjacent to ends respectively connectable to two of the cleats.

13. The shoe of claim 12, wherein at least one of said straps is coupled between the rearward connection points, and wherein the at least one said strap is displaceable to a position in front of and a position behind an ankle of the wearer, by pivoting ends of said strap relative to respective ones of the cleats.

14. The shoe of claim 11, wherein the receptacle is defined by a slot in the shaft.

15. A shoe comprising:

a sole shaped to support a human foot;

a forward connection point located at a point on the sole corresponding to a space between a great toe and a second toe of the foot;

at least two rearward connection points located on the sole adjacent to lateral edges of the sole and spaced rearward from the forward connection point;

wherein the forward and rearward connection points each comprise a post affixed to the sole, defining a shaft extending upwardly from the sole to a cleat formed by an enlargement integral with the post at a space above the sole;

wherein the posts of said two rearward connection points are inclined laterally outwardly by substantially a right angle adjacent to the cleat thereon; and, further comprising at least one upper part having openings spaced and configured removably to engage the cleats.

16. The shoe of claim 15, wherein the cleats of the rearward connection points are spaced from the right angle by a distance corresponding to at least one thickness of the upper part.

* * * * *